US006326337B1

(12) United States Patent
Eapen et al.

(10) Patent No.: US 6,326,337 B1
(45) Date of Patent: Dec. 4, 2001

(54) PERFLUOROPOLYALKYLETHER LUBRICANT FORMULATION WITH IMPROVED STABILITY

(75) Inventors: Kalathil C. Eapen, Beavercreek; Grace J. Chen, Fairborn; Wayne E. Ward, Dayton; Harvey L. Paige, Yellow Springs, all of OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/825,840

(22) Filed: Apr. 4, 2001

(51) Int. Cl.[7] ..... C10M 135/28
(52) U.S. Cl. ..... 508/570; 508/571; 568/56
(58) Field of Search ..... 508/570, 571; 568/56

(56) References Cited

U.S. PATENT DOCUMENTS

| | | | | |
|---|---|---|---|---|
| 2,790,772 | * | 4/1957 | Hughes et al. | 508/570 |
| 3,666,769 | | 5/1972 | Jones et al. . | |
| 3,720,614 | * | 3/1973 | Clark | 508/570 |
| 3,748,269 | * | 7/1973 | Clark | 508/570 |
| 3,844,962 | * | 10/1974 | Clark | 508/570 |
| 4,172,959 | | 10/1979 | Kaiser . | |
| 5,015,405 | | 5/1991 | Kar et al. . | |
| 5,302,760 | | 4/1994 | Gschwender et al. . | |
| 5,441,655 | | 8/1995 | Odello et al. . | |
| 5,618,778 | * | 4/1997 | Wirth et al. | 508/274 |
| 5,663,127 | * | 9/1997 | Flynn et al. | 508/250 |

* cited by examiner

*Primary Examiner*—Jacqueline V. Howard
(74) *Attorney, Agent, or Firm*—Charles E. Bricker; Thomas L. Kundert

(57) ABSTRACT

An oxidation-corrosion additive for enhancing the stability of PFPAEs which has the formula:

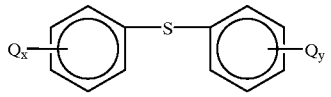

wherein Q is —$R_f$ or —S—$R_f$, $R_f$ is a perfluoroalkyl or perfluoroalkylether group having 1 to 30 carbon atoms, x and y are integers, each having a value of 0–5, wherein the sum of x and y is in the range of 1 to 10. In the formula above, $R_f$ may be linear or branched. The additive can be a single component or a mixture of components varying in the number and relative positions of x and y. The additive can be used alone or with other suitable additives in PFPAE base fluids.

8 Claims, No Drawings

PERFLUOROPOLYALKYLETHER LUBRICANT FORMULATION WITH IMPROVED STABILITY

RIGHTS OF THE GOVERNMENT

The invention described herein may be manufactured and used by or for the Government of the United States for all governmental purposes without the payment of any royalty.

BACKGROUND OF THE INVENTION

The present invention relates to perfluoropolyalkylether (PFPAE) formulations having enhanced resistance to fluid oxidation and to the corrosion of metals. In particular, the present invention relates to additives to be used with a PFPAE base fluid, as well as procedures for synthesizing these additives.

Perfluoropolyalkylethers (PFPAEs) have long been of interest as lubricant base fluids because of their good thermal and oxidative stability and their wide liquid range. These properties make them particularly well suited for advanced high-efficiency turbine engines for aerospace applications. The practical utility of the commercial fluids for aerospace and military applications has been limited due to corrosion of metal components exposed to these fluids under extreme use conditions.

Deficiencies in lubricant base fluids have generally been mitigated and performance improved by the use of various additives. Conventional additives developed for improvement of a variety of specific properties of petroleum-derived or synthetic hydrocarbon base fluids are generally not suitable for perfluorinated fluids, because of a lack of solubility and efficacy. One method for making the conventional additives soluble in perfluorinated fluids is to synthesize molecules having the same functional groups, but with perfluoroalkyl or perfluoroalkylether moieties. While this generally improves the solubility of the compounds, it typically changes the properties of the critical functional groups and renders the additives ineffective. These difficulties are well known to those familiar with the art. In spite of these difficulties, a few useful additives have been developed for perfluorinated fluids.

An early class of such additives improving the oxidation/corrosion properties of PFPAE oils and greases, comprised compounds described as perfluoroalkylether (PFAE) substituted arylphosphines. While these compounds are still of interest, other more easily synthesized, and sometimes more effective, classes of compounds have been disclosed in more recent patents. Closely related to the phosphines are the perfluoroalkyl- and perfluoroalkylether-substituted aryl phosphates and phosphonates, which have been claimed to be effective as multi-purpose additives.

Fluorinated derivatives of phenoxyphosphazenes were first disclosed as fluids or additives to improve friction and wear properties in U.S. Pat. No. 5,015,405. This same class of compounds was later found to improve resistance to oxidation and corrosion in PFPAE fluids as disclosed in U.S. Pat. No. 5,441,655. Likewise, PFAE substituted benzothiazoles and bis-benzothiazoles were initially suggested as fluids (U.S. Pat. No. 3,666,769) and were later found to be effective additives for the prevention of oxidation and corrosion.

Another class of compounds that has been found to improve resistance to oxidation and corrosion in PFPAE fluids is the PFAE-substituted s-triazines. It was also found that diphenyl ethers substituted only with perfluoroalkyl groups were soluble in PFPAE fluids and provided a measure of protection against oxidation-corrosion stability (U.S. Pat. No. 5,302,760).

All of the foregoing additives, when dissolved in PFPAE fluids, reduce fluid oxidation and reduce the corrosion of certain metal components exposed to the fluids at high temperatures in an oxidative environment. However, all are limited in usefulness by an inability to provide protection from oxidation and corrosion up to about 330° C., or by being particularly difficult and expensive to synthesize, or both. It is desirable to have an additive that minimizes high-temperature oxidation-corrosion reactions in PFPAE fluids at the highest temperature possible, yet is simple and inexpensive to synthesize and have sufficient solubility at sub-ambient temperatures.

Accordingly, it is an object of this invention to provide an easily synthesized, novel oxidation-corrosion additive for enhancing the stability of PFPAEs.

It is another object of the invention to provide a lubricant composition that can be used in the temperature range −40° C. (−40° F.) to 330° C. (625° F.) causing little or no corrosion to ferrous alloys.

It is yet another object of the invention to provide a lubricant composition which is stable to thermo-oxidative degradation when exposed to metals at up to about 330° C. (625° F.).

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the present invention there is provided an oxidation-corrosion additive for enhancing the stability of PFPAEs which has the formula:

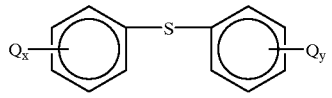

wherein Q is —$R_f$ or —S—$R_f$, $R_f$ is a perfluoroalkyl or perfluoroalkylether group having 1 to 30 carbon atoms, x and y are integers, each having a value of 0–5, wherein the sum of x and y is in the range of 1 to 10. In the formula above, $R_f$ may be linear or branched. The additive can be a single component or a mixture of components varying in the number and relative positions of x and y. The additive can be used alone or with other suitable additives in PFPAE base fluids.

DETAILED DESCRIPTION OF THE INVENTION

The disubstituted phenyl thioether additive may be prepared by coupling a perfluoroalkylfluorobenzene with sodium sulfide in a suitable solvent, such as, for example, 1-methyl-2-pyrrolidinone (NMP). The perfluoroalkylfluorobenzene ($R_f$—$C_6H_4$—F), in turn, is prepared by heating an appropriate perfluoroalkyliodide, wherein $R_f$ is a perfluoroalkyl group having 1 to 30 carbons in a linear or branched configuration, with fluoroiodobenzene and copper in a suitable solvent, such as, for example, dimethyl sulfoxide (DMSO).

The analogous bis((perfluoroalkyl)thiophenyl)thioethers are also easily synthesized, by reacting 4,4'-thiobisbenzenethiol with a strong base, such as, for example, potassium t-butoxide, then reacting the resulting metal salt with a perfluroroalkyl iodide.

A mixture of isomers of perfluoroalkyl- or perfluoroalkylether-substituted diphenyl thioethers may be made by heating together a perfluoroalkyl iodide or perfluoroalkylether iodide and diphenylthioether in the presence of sodium acetate in a pressure vessel. The synthesis process involves formation and reaction of free radical intermediates.

The bis(perfluoroalkylphenyl)thioether or bis ((perfluoroalkyl)thiophenyl)-thioethers of this invention are dissolved in a perfluoropolyalkylether fluid in amounts ranging from 0.01 to 3.00 percent by weight to provide fluids of enhanced stability under oxidation-corrosion conditions. These additives can be used alone or with other suitable additives in PFPAE base fluids. Preferred base fluids are those of the general formula:

$$R_fO(Z)_m(Y)_nR_f$$

wherein $R_f$ is a lower perfluoroalkyl group such as —$CF_3$, —$C_2F_5$, —$C_3F_7$ and the like, Z is —$CX_2CX_2O$—, —$CX_2CX_2CX_2O$—, or —$CX_2OCX_2CX_2O$—, where X is —F, —$CF_3$, —$C_2F_5$ and the like, and Y is —CFXO—, m and n are integers whose sum is between 2 and 200, and the ratio of n to m is between 0 and 10, and wherein Z and Y are statistically distributed along the PFPAE chain. Commercial fluids of this type have been available for some time, Fomblin Y® and Fomblin Z® from Ausimont (Italy). Other important commercial fluids have n=0, for example Krytox ® from DuPont (USA) which has Z=—$CF_2CF(CF_3)O$—, and Demnum® from Daikin (Japan) which has Z=—$CF_2CF_2CF_2O$—.

The following examples illustrate the invention:

EXAMPLE I

1-Fluoro-3-(perfluorohexyl) benzene was prepared by heating 6.02 g 1-fluoro-3-iodobenzene and 13.3 g perfluorohexyl iodide with excess copper in dimethyl sulfoxide (DMSO) at approximately 125° C. for 24 hours. The product, 1 -fluoro-3-perfluorohexyl benzene, was obtained in good yield (10.0 g, 89%).

A mixture of 1-fluoro-3-(perfluorohexyl) benzene (10.0 g, 24.2 mmole) and sodium sulfide, $Na_2S$ (1.01 g, 12.9 mmole) in 45 mL of 1-methyl-2-pyrrolidinone (NMP) was heated at 140–170° C. for five days. After cooling to ambient temperature, the reaction mixture was hydrolyzed in 40 mL of 2 M hydrochloric acid. The fluorocarbon layer was washed with water. The water layer was extracted with ether (2×50 mL) and the ether extract was washed with water and dried over $MgSO_4$. The fluorocarbon and ether layers were combined and distilled to give 7.37 g of bis[(3-perfluorohexyl)-1-phenyl]thioether ("DPTE1," bp 142 ° C. /0.015 torr, 74% yield). The infrared and nmr spectra were consistent with the proposed structure. The mass spectrum showed a molecular ion at m/z=822 and M—$C_5F_{11}$ at m/z =553. Elemental analysis further confirmed the composition of the compound; Calculated for $C_{24}H_8F_{26}S$: C, 35.05%; H, 0.98%; F, 60.07%; S, 3.90%; Found: C, 34.52%; H, 0.88%; F, 59.59%; S, 4.62%.

EXAMPLE II

Using the method described in Example I, a mixture of 1-fluoro-4-(perfluorohexyl) benzene (9.90 g, 23.9 mmole) and sodium sulfide, $Na_2S$ (0.95 g, 12.2 mmole) in 50 mL of 1-methyl-2-pyrrolidinone (NMP) was heated at 140–170° C. for three days. After cooling to ambient temperature, the reaction mixture was hydrolyzed in 40 mL of 2 M hydrochloric acid. The fluorocarbon layer was washed with water. The water layer was extracted with ether (2×50 mL) and the ether extract was washed with water and dried over $MgSO_4$. The fluorocarbon and ether layers were combined and distilled to give 2.2 g of bis[(4-perfluorohexyl)-1-phenyl] thioether ("DPTE2," bp 135–155° C. /0.0.001 torr, 95% purity) in 22% yield. The sample was further purified by preparative gas chromatography to give a product with a melting point of 55 ° C. The infrared, nmr, and mass spectra and elemental analysis all were consistent with the proposed structure.

EXAMPLE III

A solution of 4,4'-thiobisbenzenethiol (5.01 g, 20.0 mmol) in N,N-dimethylformamide (DMF, 30 mL) was added dropwise to an ice-cooled mixture of potassium t-butoxide (4.48 g, 40.0 mmol) in DMF (100 mL). The resulting mixture was stirred for 10 minutes, followed by the dropwise addition of n-perfluorohexyl iodide (18.4 g, 40.0 mmol). The mixture was then warmed to room temperature. After stirring for an additional hour at room temperature, gas chromatographic analysis indicated complete conversion to the desired product. Any unreacted potassium t-butoxide was hydrolyzed with 1M HCI (100 mL) and the organic product was extracted with 300 mL of diethyl ether. The ether layer was washed with water (4×50 mL) and dried over $MgSO_4$. After drying, the ether was removed and the product was distilled to yield the product, $C_6F_{13}$—S—$C_6H_4$—S—$C_6H_4$—S—$C_6F_{13}$ ("DPTE3," m.p. 46° C., b.p. 169–176° C. at 0.1g, 92% yield). The infrared and nmr spectra were consistent with the proposed structure. The mass spectrum showed a molecular ion at m/z=886 and M-F at m/z=867. Elemental analysis further confirmed the composition of the compound; Calculated for $C_{24}H_8F_{26}S_3$: C, 32.52%; H, 0.97%; S, 10.85%; Found: C, 31.64%; H, 0.79%; S, 11.16%.

EXAMPLE IV

A mixture of perfluoro-n-hexyl iodide (95.9 g, 215 mmole), diphenyl thioether (10.0 g, 54.0 mmole) and sodium acetate (17.63 g, 215 mmole) was placed in a 450 ml stainless steel pressure reactor under a nitrogen atmosphere. The reaction vessel was closed and heated to 190+/−2° C., and maintained at that temperature for 3 days. A pressure of ~90 psi was observed during heating. After the reaction, the reactor was allowed to cool to ambient temperature and carefully opened. The product was filtered to obtain a dark brown liquid which was distilled to collect a fraction ("DPTE4") boiling at 125–127° C. /0.005 mm Hg. as a pale yellow liquid. Yield, 20 g, 45%. This fraction was essentially a mixture of disubstitution products as verified by GC/MS. Elemental analysis further confirmed the composition; Calculated for $C_{24}H_8F_{26}S$: C, 35.05%; H, 0.98%; F, 60.07%; S, 3.90%; Found: C, 34.54%; H, 0.98%; F, 61.82%; S, 4.34%. This material was soluble in Demnum-S65 at a 1% concentration. The solution remained clear at −40° C. for 24 hours.

EXAMPLE V

A one percent (w/w) formulation of bis[(3-perfluorohexyl)-1-phenyl]thioether (DPTE1) in Demnum S-65® was prepared. Micro oxidation-corrosion tests were performed using this formulation with various steel alloy coupons at 315°C. and 330° C. Briefly, dry air is bubbled through 6 ml of fluid for 24 hours at a rate of one liter per hour at a specified temperature. The test is performed in the overboard configuration, with the air and any gases from the test vented rather than passing through a reflux condenser. The steel alloy coupons, as listed in Table I, are stacked on the air inlet tube separated by glass spacers, all immersed in the fluid. The metals serve to catalyze fluid degradation. At the end of the test, the fluid property changes and metal weight changes are determined. Results of the tests are shown in Table I.

TABLE I

| Measured Properties | Base Oil @ 315° C. | Base Oil + 1% DPTE1 @ 315° C. | Base Oil @ 330° C. | Base Oil + 1% DPTE1 @ 330° C. |
|---|---|---|---|---|
| Viscosity Change (%) | 1.45 | 2.19 | 1.45 | 2.88 |
| Wt Loss (%) | 2.31 | 0.12 | 8.45 | 0.47 |
| Metal Wt Change (in mg/cm$^2$) | | | | |
| 4140 | 3.16 | 0.14 | 3.07 | 0.14 |
| 52100 | 1.65 | 0.19 | 2.08 | 0.11 |
| 410 | 0.83 | 0.11 | 1.79 | 0.24 |
| M50 | 2.56 | 0.27 | 1.11 | 0.33 |
| 440C | 1.37 | 0.05 | 2.19 | 0.08 |

EXAMPLE VI

A one percent (w/w) formulation of bis[(4-perfluorohexyl)-1-phenyl]thioether (DPTE2) in Krytox 143AC® was prepared. Micro oxidation-corrosion tests were performed using this formulation in the same manner as described in Example V. Results of the tests are shown in Table II.

TABLE II

| Measured Properties | Base Oil @ 315° C. | Base Oil + 1% DPTE2 @ 315° C. | Base Oil @ 330° C. | Base Oil + 1% DPTE2 @ 330° C. |
|---|---|---|---|---|
| % Viscosity Change | 6.82 | 3.09 | −4.71 | 3.71 |
| % Wt Loss | 4.03 | 0.95 | 21.61 | 1.40 |
| Metal Wt Change (in mg/cm$^2$) | | | | |
| 4140 | 1.26 | 0.73 | −5.42 | 0.26 |
| 52100 | 1.70 | 0.14 | −7.48 | 0.35 |
| 410 | 1.02 | 0.02 | −7.73 | 0.30 |
| M50 | 0.50 | 0.74 | −5.52 | 0.53 |
| 440C | −0.54 | 0.08 | −10.76 | 0.00 |

EXAMPLE VII

A one percent (w/w) formulation of the mixed product (DPTE4) in Demnum S-65® was prepared. Micro oxidation-corrosion tests were performed using this formulation in the same manner as described in Example IV. Results of the tests are shown in Table III.

TABLE III

| Measured Properties | Base Oil 330° C. | Base Oil + 1% DPTE4 @ 330° C. |
|---|---|---|
| % Viscosity Change | 1.45 | 3.75 |
| % Wt Loss | 8.45 | 0.45 |

TABLE III-continued

| Measured Properties | Base Oil 330° C. | Base Oil + 1% DPTE4 @ 330° C. |
|---|---|---|
| Metal Wt Change (in mg/cm$^2$) | | |
| 4140 | 3.07 | 0.07 |
| 52100 | 2.08 | 0.12 |
| 410 | 1.79 | 0.02 |
| M50 | 1.11 | 0.26 |
| 440C | 2.19 | 0.01 |

The invention described herein represents a significant improvement in the state of the art relative to the use of PFPAEs as high-temperature liquid lubricants. Other applications of the fluids could include use in high temperature hydraulic applications and high temperature machine lubrication or cooling operations. Other applications will be obvious to those skilled in the field. The additive could also be incorporated into to high-temperature PFPAE greases.

Having thus described exemplary embodiments of the present invention, it should be noted by those skilled in the art that the disclosures herein are exemplary only and that alternatives, adaptations and modifications may be made within the scope of the present invention.

We claim:

1. An oxidation-corrosion additive for enhancing the stability of perfluoropolyalkylethers which has the formula:

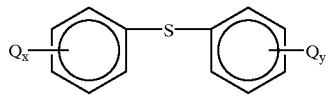

wherein Q is —$R_f$ or —S—$R_f$, $R_f$ is a perfluoroalkyl or perfluoroalkylether group having 1 to 30 carbon atoms, x and y are integers, each having a value of 0–5, wherein the sum of x and y is in the range of 1 to 10, and wherein $R_f$ is linear or branched.

2. The additive of claim 1 wherein x=y=1 and Q is —$C_6F_{13}$.

3. The additive of claim 1 wherein x=y=1 and Q is —S—($_6F_{13}$.

4. The additive of claim 1 wherein x or y has a value greater than 1 and Q is —$C_6F_{13}$.

5. A perfluorinated fluid having improved stability consisting essentially of a perfluoropolyalkylether and about 0.01 to 3.0 weight percent of an additive of the formula

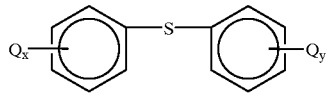

wherein Q is —$R_f$ or —S—$R_f$, $R_f$ is a perfluoroalkyl or perfluoroalkylether group having 1 to 30 carbon atoms, x and y are integers, each having a value of 0–5, wherein the sum of x and y is in the range of 1 to 10, and wherein $R_f$ is linear or branched.

6. The fluid of claim 5 containing about 1.0 weight percent of said additive, wherein x=y=1 and Q is —$C_6F_{13}$.

7. The fluid of claim 5 containing about 1.0 weight percent of said additive, wherein x=y=1 and Q is —S—$C_6F_{13}$.

8. The fluid of claim 5 containing about 1.0 weight percent of said additive, wherein x or y has a value greater than 1 and Q is —$C_6F_{13}$.

* * * * *

UNITED STATES PATENT AND TRADEMARK OFFICE

CERTIFICATE OF CORRECTION

PATENT NO. : 6,326,337 B1 
DATED : December 4, 2001
INVENTOR(S) : Kalathil C. Eapen et al.

It is certified that error appears in the above-identified patent and that said Letters Patent is hereby corrected as shown below:

Column 4,
Line 25, "0.1g" should read -- 0.1 mm Hg, 16.3 g --.

Column 6,
Line 43, "-S-($_6F_{13}$" should read -- -S-$C_6F_{13}$ --.

Signed and Sealed this

Third Day of September, 2002

*Attest:*

JAMES E. ROGAN
*Director of the United States Patent and Trademark Office*

*Attesting Officer*